US006359590B2

(12) United States Patent
Takenoshita

(10) Patent No.: US 6,359,590 B2
(45) Date of Patent: Mar. 19, 2002

(54) ANTENNA FEEDER LINE, AND ANTENNA MODULE PROVIDED WITH THE ANTENNA FEEDER LINE

(75) Inventor: Takeshi Takenoshita, Kyoto (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 09/865,831

(22) Filed: May 25, 2001

(30) Foreign Application Priority Data

May 26, 2000 (JP) ..... 2000-156516

(51) Int. Cl.[7] ..... H01Q 1/38; H01Q 13/00

(52) U.S. Cl. ..... 343/700 MS; 343/767; 343/771; 343/785

(58) Field of Search ..... 343/700 MS, 767, 343/770, 771, 785; 333/240, 137

(56) References Cited

U.S. PATENT DOCUMENTS 4,755,821 A * 7/1988 Itoh et al. ..... 343/700 MS
5,831,581 A * 11/1998 Keough ..... 343/725
6,133,877 A * 10/2000 Sandstedt et al. .... 343/700 MS

FOREIGN PATENT DOCUMENTS

JP 2-280504 11/1990
JP 10-075108 3/1998
JP 10-303612 11/1998

* cited by examiner

*Primary Examiner*—Tan Ho
(74) *Attorney, Agent, or Firm*—Hogan & Hartson, L.L.P.

(57) ABSTRACT

An antenna feeder line of the invention comprises a dielectric substrate, a first main conductor layer, a second main conductor layer, through conductor groups in two rows and sub conductor layers, which form a dielectric waveguide line, wherein a slot is provided in the first main conductor layer of the dielectric waveguide line, high-frequency signals are fed to an antenna device disposed above the slot, and a grounding conductor comprising a conducting bar and/or a conductor layer, for electrically connecting the first and second surfaces constituting H surfaces is disposed in a position which is perpendicular to a signal transmission direction and at a distance substantially not more than ½ the distance between E surfaces from side surfaces constituting the E surfaces, in a transmission area within a distance substantially the same as the signal wavelength from the slot to the input side or the side opposite thereto.

4 Claims, 3 Drawing Sheets

ANTENNA FEEDER LINE, AND ANTENNA MODULE PROVIDED WITH THE ANTENNA FEEDER LINE

BACKGROUND OF THE INVENTION

1. Field of the Invention

The present invention relates to a dielectric waveguide line which is used as a feeder line for any kinds of antenna device suitable for communication using high-frequency signals within a microwave band, a millimeter wave band or the like, and more particularly, to an antenna feeder line capable of feeding power to the antenna device with high efficiency by reducing reflection of high-frequency signals at a connection of the feeder line and the antenna device, and an antenna module provided with the antenna feeder line.

2. Description of the Related Art

An example of methods proposed as methods of feeding power to an antenna device that emits electromagnetic waves such as microwaves or millimeter waves is a slot fed antenna where power is fed from a feeder line to the antenna device through a slot which is a conductor non-formed portion. The slot-fed system is widely used because of having a simple structure, and antennas using a line such as a microstrip line, a strip line, a coplanar line or a waveguide line as the feeder line have been proposed. Moreover, it is widely performed to arrange a plurality of antenna devices into an array in order to obtain a desired antenna emission pattern. In doing this, it is necessary to branch the feeder line in accordance with the number of the antenna devices to feed power in series or in parallel. In the case of the microstrip line, strip line and coplanar line, there are such problems that unnecessary electromagnetic wave emission or an interaction between lines occurs where there is a portion in which the impedance is discontinuous.

To solve this problem, the inventors of the invention have proposed in Japanese Unexamined Patent Publication JP-A 10-303612 (1998) a structure in which power is fed to an antenna device with a slot being provided in a conductor layer of a dielectric waveguide line having a multilayer structure and comprising the conductor layer and a via hole (via conductor). According to the feeder line structure, since electromagnetic waves propagate only through an area surrounded by conductors, no unnecessary emission occurs, whereby an interaction between lines can be prevented.

However, even in the feeder line disclosed in JP-A 10-303612, with which power is fed to the antenna through the slot provided in the dielectric waveguide line, the impedance is discontinuous in the slot portion. Consequently, the reflection is large at frequencies in the vicinity of the resonance frequency of the slot, and particularly in a series-feed antenna, waves reflected at the power-fed slot in each device are accumulated, resulting in an extremely large total reflection.

SUMMARY OF THE INVENTION

The invention is made to solve the above-mentioned problem of the prior art, and an object thereof is to provide an antenna feeder line capable of feeding power to an antenna device with high efficiency by suppressing the reflection loss of high-frequency signals of a desired frequency at a conductor non-formed portion.

Another object of the invention is to provide an antenna module capable of feeding power with high efficiency and excellent emission characteristics.

As a result of examinations of the above-mentioned problem, the inventors of this application have found that reflection of high-frequency signals that occurs at the slot which is a conductor non-formed portion can be reduced by disposing at least one conductor comprising a conducting bar of a via hole and a conductor layer of a metalized pattern in a position at a distance within a predetermined range from the slot.

The invention provides an antenna feeder line comprising: a dielectric substrate composed of a lamination of a plurality of dielectric layers; a first main conductor layer formed on one surface of the dielectric substrate; a second main conductor layer formed on the other surface of the dielectric substrate; two through conductor groups in two rows formed within the dielectric substrate, each of the two through conductor groups being composed of a plurality of through conductors electrically connecting the first main conductor layer and the second main conductor layer at predetermined intervals; and sub conductor layers for electrically connecting the through conductor groups, interposed between the dielectric layers, wherein the first main conductor layer, the second main conductor layer, the two through conductor groups and the sub conductor layers form a dielectric waveguide line where a high-frequency signal is transmitted through a transmission area surrounded by the first main conductor layer, the second main conductor layer, the through conductor groups and the sub conductor layers, a conductor non-formed portion is provided in the first main conductor layer of the dielectric waveguide line, the high-frequency signal is fed to an antenna device disposed above the conductor non-formed portion, through the conductor non-formed portion, and a grounding conductor for electrically connecting the first and second main conductor layers constituting H surfaces is disposed in a position which is perpendicular to a signal transmission direction and at a distance substantially not more than ½ a distance between the side surfaces constituting E surfaces of the dielectric waveguide line from the side surfaces, within a distance substantially the same as a wavelength of the high-frequency signal from the conductor non-formed portion to a high-frequency signal input side or a side opposite thereto.

The invention provides an antenna module comprising: the antenna feeder line of the above-described structure; and an aperture antenna or linear antenna, disposed on the first main conductor layer of the antenna feeder line and fed with the high-frequency signal through the conductor non-formed portion.

According to the antenna feeder line of the invention, for the problem that since the impedance is discontinuous because of the provision of the conductor non-formed portion which is a power feeding slot on the dielectric waveguide line, the electromagnetic wave of the high-frequency signal is reflected at the slot, the grounding conductor for suppressing reflection comprising a conducting bar and/or a conductor layer and electrically connecting the first and second main conductor layers constituting the H surfaces of the dielectric waveguide line is disposed in a position at a distance within the distance substantially the same as the wavelength of the transmitted high-frequency signal from the slot to the signal input side or the side opposite thereto in parallel to the signal transmission direction and in a position which is perpendicular to a signal transmission direction and at the distance substantially not more than ½ the distance between the side surfaces constituting the E surfaces of the dielectric waveguide line from the E surfaces of the dielectric waveguide line, whereby the reflection of the electromagnetic wave can be reduced. That is, the above-mentioned position in which the grounding conductor including a conducting bar and/or a conductor layer is disposed is set so that the following effect is obtained: The amplitude of the electromagnetic wave reflected at the slot and the amplitude of the electromagnetic wave reflected at the grounding conductor comprising a conducting bar and/or a conductor layer are made the same so that the phases thereof are different by 180 degrees, whereby the electromagnetic waves cancel out each other. Consequently, power can be fed to the antenna device with high efficiency.

Moreover, according to the antenna module of the invention, power can be fed to the antenna device with high efficiency because the antenna module comprises the antenna feeder line of the above-described structure; and an aperture antenna (a multilayer aperture antenna, a horn antenna or the like) or linear antenna (a patch antenna, a microstrip antenna, a printed dipole antenna or the like) which is an antenna device disposed on the first main conductor layer of the antenna feeder line and fed with the high-frequency signal through the conductor non-formed portion. Consequently, the antenna module can be made to function as an antenna of a microwave band or millimeter wave band having an excellent emission characteristic.

The invention provides an antenna feeder line comprising: a dielectric substrate composed of a lamination of a plurality of dielectric layers; a first main conductor layer formed on one surface of the dielectric substrate; a second main conductor layer formed on the other surface of the dielectric substrate; two through conductor groups in two rows formed within the dielectric substrate, each of the two through conductor groups being composed of a plurality of through conductors electrically connecting the first main conductor layer and the second main conductor layer at predetermined intervals; and sub conductor layers for electrically connecting the through conductor groups, interposed between the dielectric layers, wherein the first main conductor layer, the second main conductor layer, the two through conductor groups and the sub conductor layers form a dielectric waveguide line where a high-frequency signal is transmitted through a transmission area surrounded by the first main conductor layer, the second main conductor layer, the through conductor groups and the sub conductor layers, a conductor non-formed portion is provided in the first main conductor layer of the dielectric waveguide line, the high-frequency signal is fed to an antenna device disposed above the conductor non-formed portion, through the conductor non-formed portion, and a grounding conductor the side surfaces constituting H surfaces is disposed in a position which is perpendicular to a signal transmission direction and at a distance substantially not more than ½ a distance between the first and second main conductor layers constituting the E surfaces of the dielectric waveguide line from the first and second main conductor layers, within a distance substantially the same as a wavelength of the high-frequency signal from the conductor non-formed portion to a high-frequency signal input side or a side opposite thereto.

Moreover, the invention provides an antenna module comprising the antenna feeder line of the above-described structure; and an aperture antenna or linear antenna disposed on the first main conductor layer of the antenna feeder line and fed with the high-frequency signal through the conductor non-formed portion.

According to the antenna feeder line of the invention, for the problem that since the impedance is discontinuous because of the provision of the conductor non-formed portion which is a power feeding slot on the dielectric waveguide line, the electromagnetic wave of the high-frequency signal is reflected at the slot, the grounding conductor for suppressing reflection including a conducting bar and/or a conductor layer and electrically connecting the side surfaces constituting the H surfaces of the dielectric waveguide line is disposed in a position which is at a distance within the distance substantially the same as the wavelength of the transmitted high-frequency signal from the slot to the signal input side or the side opposite thereto in parallel to the signal transmission direction and is at the distance substantially not more than ½ the distance between the first and second main conductor layers constituting the E surfaces of the dielectric waveguide line perpendicularly from the E surfaces of the dielectric waveguide line, whereby the reflection of the electromagnetic wave can be reduced. That is, the position in which the grounding conductor comprising a conducting bar and/or a conductor layer is disposed is set so that the following effect is obtained: The amplitude of the electromagnetic wave reflected at the slot and the amplitude of the electromagnetic wave reflected at the grounding conductor comprising a conducting bar and/or a conductor layer are made the same so that the phases thereof are different by 180 degrees, whereby the electromagnetic waves cancel out each other. Consequently, power can be fed to the antenna device with high efficiency.

Moreover, in the antenna module of the invention, power can be fed to the antenna device with high efficiency because the antenna module-is provided with: the antenna feeder line of the invention having the above-described structure; and an aperture antenna (a multilayer aperture antenna, a horn antenna or the like) or a linear antenna (a patch antenna, a microstrip antenna, a printed dipole antenna or the like) which is an antenna device disposed on the first main conductor layer of the antenna feeder line and fed with the high-frequency signal through the conductor non-formed portion. Consequently, the antenna module can be made to function as an antenna of a microwave band or millimeter wave band having an excellent emission characteristic.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
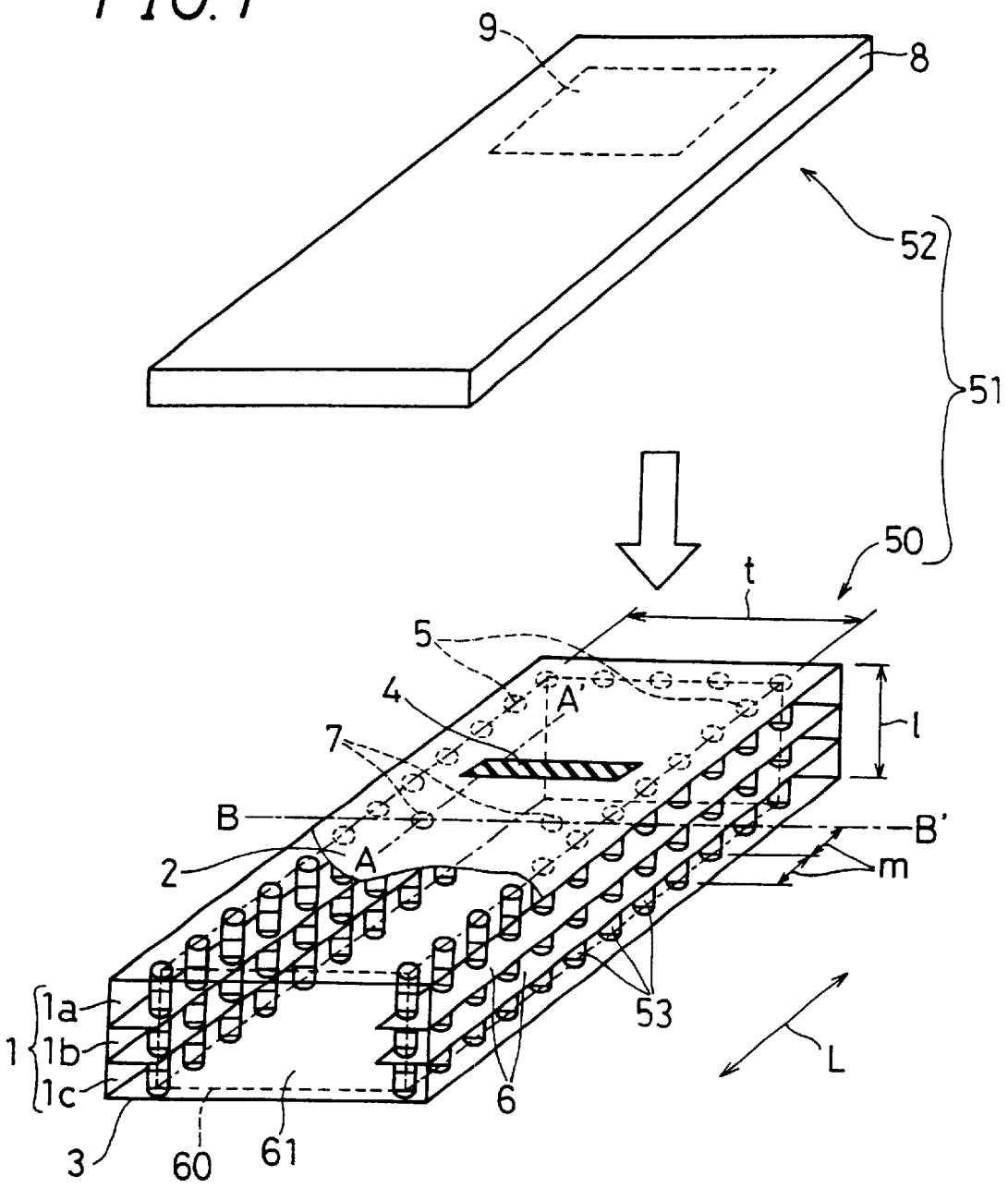
FIG. 1 is an exploded perspective view for explaining an example of an embodiment of an antenna module 51 provided with an antenna feeder line 50 of the invention.

Now referring to the drawings, preferred embodiments of the invention are described below.

An antenna feeder line and an antenna module according to an embodiment of the invention will be described with reference to the drawings.

FIG. 1 is a perspective view for explaining the structure of an example of the embodiment of an antenna module 51 provided with an antenna feeder line 50 of the invention. The antenna feeder line 50 is shown in partially cutaway perspective view, and an antenna device 52 connected to the antenna feeder line 50 to form the antenna module 51 is separately shown in perspective view.

In FIG. 1, a dielectric waveguide line 60 comprises a dielectric substrate 1 comprising a lamination of a plurality of dielectric layers 1*a*, 1*b* and 1*c*, a first main conductor layer 2 formed-on one surface of the dielectric substrate 1, and a second main conductor layer 3 formed on the other surface of the dielectric substrate 1. The dielectric substrate 1 is sandwiched between the main conductor layers 2 and 3, which constitute the top and bottom conductor walls of a dielectric waveguide line 60. A slot 4 which is a conductor non-formed portion is provided in the first main conductor layer 2. To an antenna device 9 disposed above the slot 4, high-frequency signals transmitted through the dielectric waveguide line 60 are fed. As the slot 4 is formed in the dielectric waveguide line 60, the dielectric waveguide line 60 functions as the antenna feeder line 50.

Through conductor groups 5 in two rows are formed within the dielectric substrate 1, which line through conductor comprises a plurality of through conductors 53 and being formed within the dielectric substrate 1 so as to electrically connect the first main conductor layer 2 and the second main conductor layer 3 at predetermined repetition intervals in the transmission direction L of the high-frequency signal. The through conductors 53 in each of the groups 5 are disposed at repetition intervals m of less than ½ the wavelength of the transmitted high-frequency signals. The repetition intervals m are not necessarily the same value and may be a combination of various values that are less than ½ the signal wavelength.

A sub conductor layer 6 is formed between the dielectric layers 1*a* to 1*c* so as to extend in the transmission direction L of high-frequency signals in parallel with the first main conductor layer 2 and the second main conductor layer 3, and electrically connects the through conductor groups 5 between the dielectric layers 1*a* to 1*c*. The number of the sub conductor layers 6 is formed as required and may be one or more. The sub conductor layers 6 constitute, together with the through conductor groups 5 in two rows, side conductor walls of the dielectric waveguide line 60 within the dielectric substrate 1.

As described above, the space surrounded by the conductor walls constituted by the first main conductor layer 2 and the second main conductor layer 3 and the conductor walls constituted by the through conductor groups 5 and the sub conductor layers 6 forms the dielectric waveguide line 60 within the dielectric substrate 1. The first and second main conductor layers 2 and 3 constitute the top and bottom surfaces of a transmission area 61 of the dielectric waveguide line 60. The through conductor groups 5 and the sub conductor layers 6 constitute the side surfaces of the transmission area 61. High-frequency signals are transmitted through the transmission area 61.

While there is no specific limitation on the thickness of the dielectric substrate 1, that is, the distance 1 between the first and second main conductor layers 2 and 3 (between the top and bottom surfaces of the dielectric waveguide line), in the case of use in a single mode, it is preferable that the distance 1 be approximately ½ or approximately twice the distance t (width) between the through conductor groups 5 in two rows 5. FIG. 1 shows an example in which the distance 1 between the first and second main conductor layers 2 and 3 is ½ the distance t between the through conductor groups 5 in two rows. Here, the parts constituting the H surfaces of the dielectric waveguide line 60 are the first and second main conductor layers 2 and 3 (the top and bottom surfaces), and the parts constituting the E surfaces are the through conductor groups 5 and the sub conductor layers 6 (the side surfaces). On the other hand, in cases where the distance 1 between the first and second conductor layers 2 and 3 is approximately twice the distance t (width) between the through conductor groups 5 in two rows, the parts constituting the E surfaces of the dielectric waveguide line are the first and second main conductor layers 2 and 3 (the top and bottom surfaces), while the parts constituting the H surfaces are the through conductor groups 5 and the sub conductor layers 6 (the side surfaces).

Figure 2A:
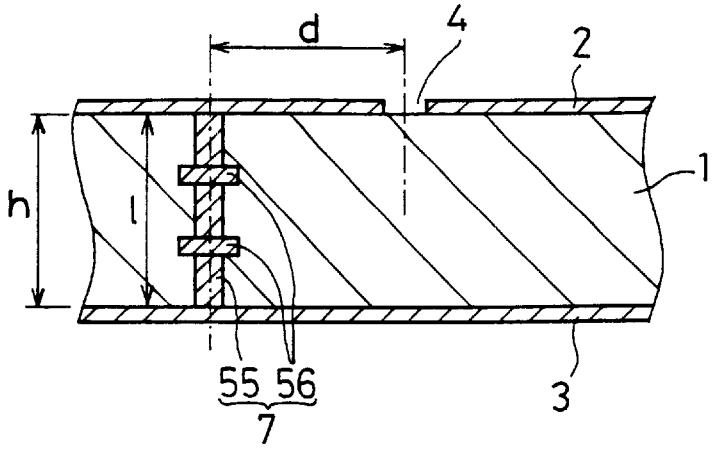
FIGS. 2A and 2B are cross-sectional views taken on the lines A–A' and B–B' of the antenna feeder line 50 shown in FIG. 1.
Figure 2B:
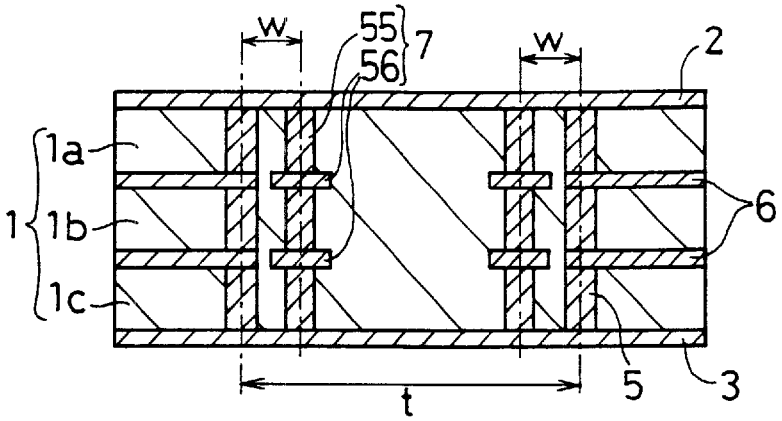
Figure 2C:
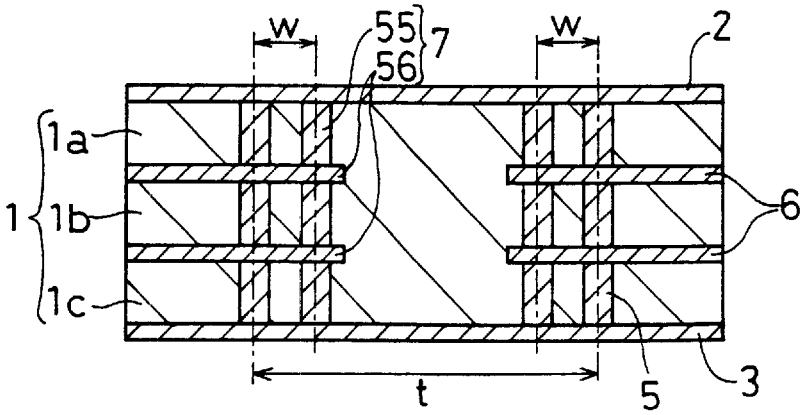
FIG. 2C is a cross-sectional view showing another example of a grounding conductor 7 in the antenna feeder line 50 of the invention.

A grounding conductor 7 for suppressing reflection is formed and disposed in a predetermined position from the slot 4 in the transmission area of the dielectric waveguide line, which grounding conductor comprises a conducting bar 55 and/or a conductor layer 56 as shown in FIGS. 2A to 2C, and electrically connects the first and second surfaces 2, 3 constituting the H surfaces. In this example, two grounding conductors 7 are disposed. The antenna feeder line 50 of the invention comprises the above-described members. The grounding conductor 7 may comprise the conducting bar 55 as described later, may comprise the conductor layer 56 or may comprise a combination of the conducting bar 55 and the conductor layer 56.

In the antenna feeder line 50 of the invention, by disposing each of the grounding conductor 7 in a predetermined position, among the high-frequency signals transmitted through the dielectric waveguide line 60 to feed the antenna device 9 through the slot 4, the electromagnetic waves of the high-frequency signals reflected at the slot 4 and the electromagnetic waves of the high-frequency signals reflected at the grounding conductor 7 cancel out each other, thereby the reflection of electromagnetic waves of high-frequency signals at the slot 4 is reduced.

It is preferable that the position in which the grounding conductor 7 comprising the conducting bar 55 and/or the conductor layer 56 is disposed be in the transmission area 61 of the dielectric waveguide line 60 within a distance almost the same as the wavelength of the high-frequency signals from the slot 4 toward the high-frequency signal input side or the side opposite thereto. This is because the electromagnetic waves reflected at the slot 4 and the electromagnetic waves reflected at the grounding conductor 7 have different phases, and these reflected electromagnetic waves are superimposed on each other to cancel out each other, whereby the reflected waves can be weakened.

Since phases of the reflected waves from the slot 4 vary according to the degree of coupling of the slot 4, when deciding the above-mentioned position it is necessary to consider the elements such as phases of waves reflected at the slot 4 and the difference between the paths of the reflected waves from the slot 4 and of the reflected waves from the grounding conductor 7. The position of the grounding conductor 7 so as to make the phase difference including the path difference 180 degrees is included in the transmission area 61 of the dielectric waveguide line 60 at a distance within the distance almost the same as the wavelength of the signal from the slot 4 toward the high-frequency signal input side or the side opposite thereto.

It is preferable to place the grounding conductor 7 in a position which is perpendicular to the signal transmission direction L and at a distance of approximately ½ or less the distance between the side surfaces or top and bottom surfaces constituting the E surfaces from the side surfaces or the top and bottom surfaces constituting the E surfaces of the dielectric waveguide line 60. This is because amplitudes of waves reflected at the grounding conductor 7 vary according to the position of the grounding conductor 7, and thus the position is selected within the above-mentioned range so that the amplitudes of the reflected waves from the grounding conductor 7 and the reflected waves from the slot 4 are approximately the same.

The grounding conductor 7 is disposed perpendicularly to the H surfaces of the dielectric waveguide line 60 and has a length almost the same as the distance between the top and bottom surfaces or side surfaces constituting the H surfaces, whereby the top and bottom surfaces or side surfaces constituting the H surfaces are electrically connected. A structure of having such a grounding conductor 7 is equivalent to a structure of having a window on the dielectric waveguide line 60, so that the impedance is made discontinuous and reflected waves having the same amplitude as the waves reflected at the slot 4 can be produced at the grounding conductor 7.

As described above, in cases where the H surfaces of the dielectric waveguide line 60 are, for example, the top and bottom surfaces as the example shown in FIG. 1, it is preferable to dispose the grounding conductor 7 in a position in the transmission area 61 of the dielectric waveguide line 60, within the distance approximately the same as the wavelength of the signal in a direction from the slot 4 toward the high-frequency signal input side or the side opposite thereto, wherein the top and bottom surfaces constituting the H surfaces are electrically connected in a position which is perpendicular to the signal transmission direction at a distance of approximately ½ or less the distance between the side surfaces constituting the E surfaces.

A dielectric substrate 8 and an antenna device 9 to which power is feedable through a slot on an aperture antenna, a linear antenna or the like, in this example, a multilayer aperture antenna which will be discussed later, forms the antenna 52 so that the reflection at the slot 4 becomes small and particularly in the case of series feeding, the reflection can be prevented from being accumulated to be extremely large. By disposing the part of the antenna device 9 of the antenna 52 above the slot 4 of the antenna feeder line 50 of the invention, the antenna module 51 of the invention is formed.

The electromagnetic waves of the high-frequency signals supplied to the dielectric waveguide line 60 are fed through the slot 4 to the antenna device 9 disposed above the slot 4, and the power fed through the slot 4 is emitted from the antenna device 9.

While a multilayer aperture antenna is used as the antenna disposed above the slot 4 in this example, a linear antenna or an aperture antenna of a different type may be used as the antenna. That is, any antenna that is of a different appearance and characteristic may be connected to form the antenna module 51, insofar as it is capable of being fed with power through the antenna feeder line 50 of the invention.

FIGS. 2A and 2B are cross-sectional views taken on the lines A–A' and B–B' of the antenna feeder line 50 shown in FIG. 1, respectively. The same members as those of FIG. 1 are designated by the same reference numerals. As shown in these figures, the grounding conductor 7 for suppressing reflection, comprising the conducting bar 55 and/or the conductor layer 56 is disposed in a position (see FIG. 2A) in the transmission area at a distance of $d \leqq \lambda 0$ for the wavelength $\lambda 0$ of the high-frequency signals from the center of the slot 4 toward the high-frequency signal input side or the side opposite thereto, in parallel with the signal transmission direction L (the horizontal direction of FIG. 2A) of the dielectric waveguide line 60, and in a position at a distance of $w \leqq t/2$ for the width t of the dielectric waveguide line 60 and perpendicular to the signal transmission direction L (the direction perpendicular to the plane of FIG. 2B) from the E surfaces of the dielectric waveguide line 60, in this example, the side surfaces of the transmission area 61 defined by the through conductor groups 5 and the sub conductor layers 6. The length l of the grounding conductor 7 is substantially the same as the distance h between the H surfaces of the dielectric waveguide line 60, in this example the top and bottom surfaces of the transmission area 61 defined by the first and second main conductor layers 2 and 3, respectively, in a direction perpendicular to the H surfaces, and the grounding conductor 7 electrically connects the first and second main conductor layers 2 and 3 constituting the top and bottom surfaces. The grounding conductor 7 is grounded by being electrically connected to the first and second main conductor layers 2 and 3 being grounded.

FIG. 2C is a cross-sectional view showing the grounding conductor 7 in another example of the embodiment of the antenna feeder line of the invention. As shown in FIG. 2C, the conductor layer 56 constituting the grounding conductor 7 is formed so as to be continuous with the sub conductor layers 6, whereby the grounding conductor 7 for suppressing reflection may be grounded by an electrical connection with the sub conductor layers 6 grounded in a similar manner to the case of the first and second main conductor layers 2 and 3. The grounding conductor 7 for suppressing reflection may be formed solely by the conducting bar 55 or the conductor layer 56 insofar as the conditions mentioned above including the predetermined position and length are satisfied.

The material of the dielectric layers 1*a* to 1*c* constituting the dielectric substrate 1 in the antenna feeder line 50 of the invention may be any kinds of dielectric material, insofar as they satisfy the conditions that they can be formed into sheets of an appropriate thickness, that conductor layers such as the first and second main conductor layers 2 and 3 and the sub conductor layers 6 comprising metalized layers can be laminated on, that the through conductor groups 5 comprising a via conductor or a through hole conductor can be formed on, and that they can be laminated in close contact with one another. Examples of the dielectric material having such characteristics include various kinds of ceramics, glass ceramics, organic resins, and a mixture of an organic resin and an inorganic powder such as ceramic powder.

To minimize the transmission loss of the high-frequency signals transmitted through the dielectric waveguide line 60, the smaller the dielectric loss of the dielectric material forming the dielectric substrate 1, the better; it is desirable that the transmission loss be not more than 0.001 in frequency of the transmitted high-frequency signals.

Further, in order to minimize the transmission loss of the high-frequency signals which is also transmitted through the dielectric waveguide line 60, it is preferable that the conductor layers such as metalized layers, including the first and second main conductor layers 2 and 3 disposed on the dielectric substrate 1 and the sub conductor layers 6 interposed between the dielectric layers 1*a* to 1*c*, as well as the via conductor or through hole conductor used as a through conductor group 5 are formed of low-resistance conductors, specifically, conductors of an alloy material including at least any one of gold, silver and copper as a main composition.

Next, a concrete example of the antenna feeder line 50 and the antenna module 51 of the invention will be described with reference to the schematic perspective view of FIG. 3.

Figure 3:
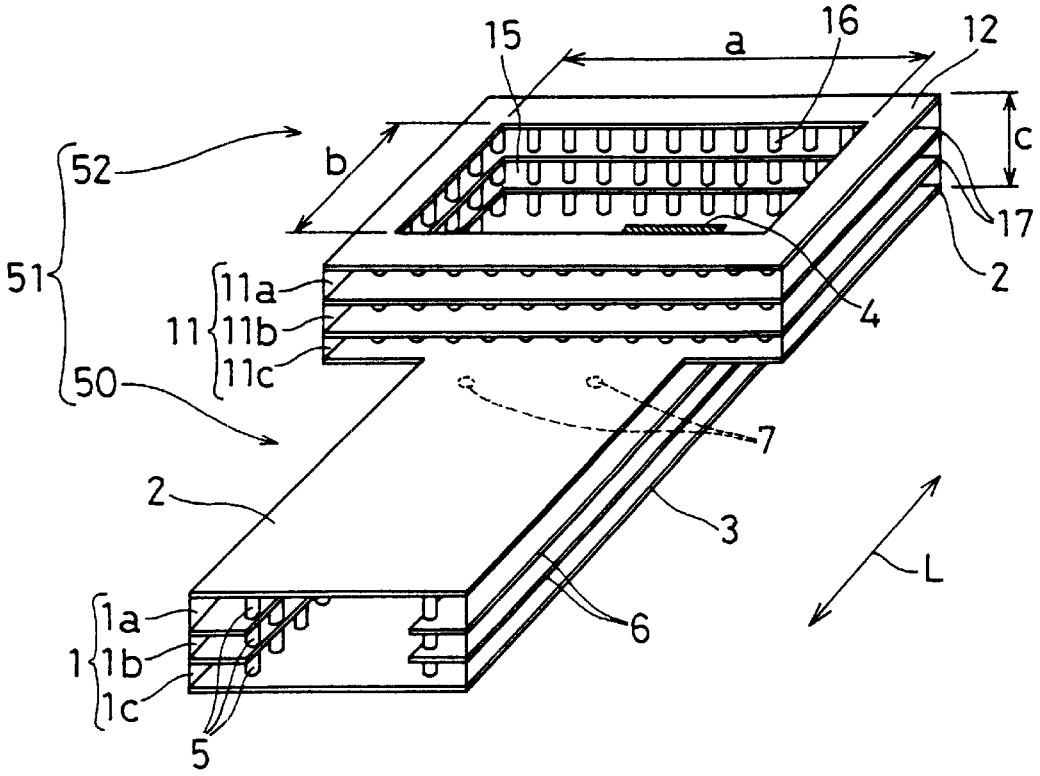
FIG. 3 is a schematic perspective view for explaining a concrete example of the antenna feeder line 50 and the antenna module 51 of the invention.

In FIG. 3, a dielectric substrate 11 comprises a lamination of a plurality of dielectric layers 11*a* to 11*c*, an first main conductor layer 12 is formed on one surface of the dielectric substrate 11, a second main conductor layer 2 is formed on the other surface of the dielectric substrate 11, a slot 4 is a conductor non-formed portion provided in the second main conductor layer 2, and a rectangular opening 15 is formed in the first main conductor layer 12 and has an area of a×b, formed in the first main conductor layer 12. The slot 4 is formed in a position, opposed to the center of the opening 15, of the second main conductor layer 2. A plurality of through conductors 16 and a plurality of sub conductor layers 17 are formed around the opening 15 within the dielectric substrate 11. The space surrounded by antenna conductor walls constituted by the first main conductor layer 12, the second main conductor layer 2, the through conductors 16 and the sub conductor layers 17 functions as a multilayer aperture antenna device 52 comprising a rectangular parallelepiped spatial resonator with an area of a×b and a thickness of c and connected to the slot 4 within the dielectric substrate 11.

As the feeder line for feeding power to the spatial resonator through the slot 4 is used the antenna feeder line 50 of the invention based on a dielectric waveguide line that the inventors of the present invention disclose in Japanese Unexamined Patent Publication JP-A 10-75108 (1998). The antenna feeder line 50 comprises the second main conductor layer 2 of the multilayer aperture antenna device 52 which is used as the first main conductor layer, the dielectric substrate 1 comprising a lamination of a plurality of dielectric layers 1*a* to 1*c*, the second main conductor layer 3, the through conductor groups 5 in two rows which electrically connect the first and second main conductor layers 2 and 3 with a predetermined width therebetween at repetitive intervals of less than ½ the wavelength of the transmitted high-frequency signals, and the sub conductor layers 6 which are interposed between the dielectric layers 1*a* to 1*c* in parallel to the first and second main conductor layers 2 and 3 and electrically connected to the through conductor groups 5. High-frequency signals are transmitted through a transmission area having the first and second main conductor layers 2 and 3 as the top and bottom surfaces, and the through conductor groups 5 in two rows and the sub conductor layers 6 as the side surfaces, which area is surrounded by the top and bottom surfaces and the side surfaces.

In the antenna feeder line 50, since the slot 4 which is a conductor non-formed portion is provided in the first main conductor layer 2, the impedance is discontinuous, so that high-frequency signals are reflected at the slot 4. However, when the length of the slot 4 is selected so that the electric power emitted from the slot 4 is, for example, 10 to 50% of the input electric power, the grounding conductor 7 for suppressing reflection comprising the conducting bar 55 and/or the conductor layer 56 is disposed in a position of $d \leqq \lambda 0/4$ for the wavelength $\lambda 0$ of the transmitted high-frequency signals from the center of the slot 4 toward the input side or the side opposite thereto in parallel with the signal transmission direction L of the antenna feeder line 50, and in a position of $w \leqq t/5$ for the distance t between the side surfaces constituting the E surfaces which are perpendicular to the signal transmission direction L and correspond to the width of the antenna feeder line 50 from the side surfaces (the through conductor groups 5 and the sub conductor layers 6) constituting the E surfaces of the antenna feeder line 50, and the top and bottom surfaces are electrically connected with the length l of the grounding conductor 7 being l=h for the distance h between the top and bottom surfaces (the first and second main conductor layers 2, 3) constituting the H surfaces of the antenna feeder line 50.

Figure 4:
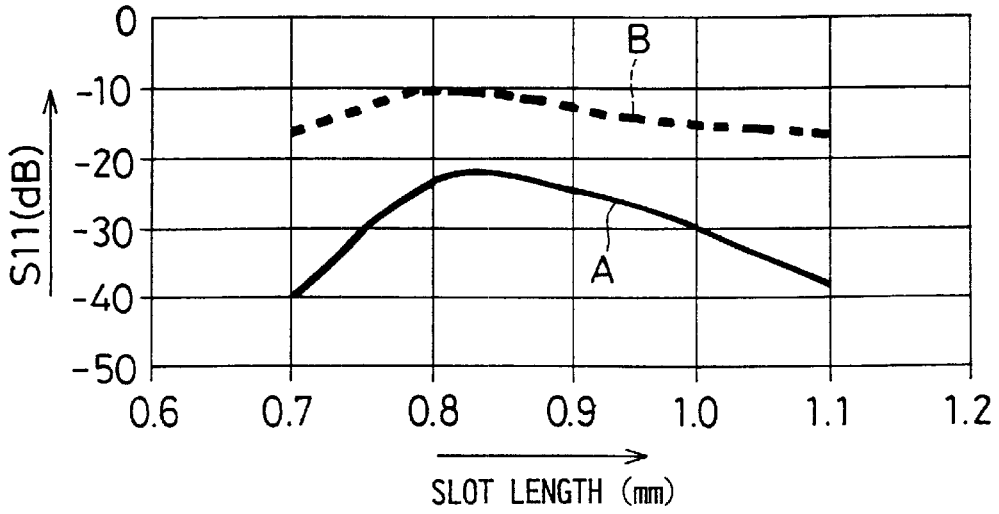
FIG. 4 is a graph showing relationships between the slot length and the reflection coefficient S11 for high-frequency signals in the concrete example of the antenna feeder line 50 and the antenna module 51 of the invention and in the comparative example.

With respect to the antenna module 51 of the invention in which the antenna feeder line 50 of the invention having the above-described structure is disposed and the antenna device 52 comprising a rectangular parallelepiped spatial resonator is disposed above the slot 4 of the antenna feeder line 50, relationships between the slot length and the reflection coefficient when a high-frequency signal of 76.5 GHz is input through the antenna feeder line 50 are shown in the graph of FIG. 4.

In FIG. 4, the horizontal axis represents the slot length (unit: mm) and the vertical axis represents the reflection coefficient S11 (unit: dB). The solid characteristic curve A represents the relationship between the slot length and the reflection coefficient in the antenna module 51 of the invention. The broken characteristic curve B represents the relationship between the slot length and the reflection coefficient in an antenna module of a comparative example in which the grounding conductors 7 for suppressing reflection are not provided, while other structures are similar to those of the antenna module of the invention. As is apparent from these results, the reflection coefficient S11 in the antenna module of the invention is lower by not less than 10 dB than that in the comparative example for all of the slot lengths. That is, in the antenna feeder line 50 and the antenna module 51 of the invention, the effect of providing the grounding conductor 7 for suppressing reflection loss of high-frequency signals which effect is obtained by is clearly demonstrated.

It is to be noted that the invention is not limited to the above-described embodiments, and various changes and improvements may be made without departing from the scope of the invention. For example, a plurality of grounding conductors may be disposed within the range of the above-described predetermined position.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An antenna feeder line comprising:

a dielectric substrate composed of a lamination of a plurality of dielectric layers;

a first main conductor layer formed on one surface of the dielectric substrate;

a second main conductor layer formed on the other surface of the dielectric substrate;

two through conductor groups in two rows formed within the dielectric substrate, each of the two through conductor groups being composed of a plurality of through conductors electrically connecting the first main conductor layer and the second main conductor layer at predetermined intervals; and sub conductor layers for electrically connecting the through conductor groups, interposed between the dielectric layers, wherein the first main conductor layer, the second main conductor layer, the two through conductor groups and the sub conductor layers form a dielectric waveguide line where a high-frequency signal is transmitted through a transmission area surrounded by the first main conductor layer, the second main conductor layer, the through conductor groups and the sub conductor layers;

a conductor non-formed portion is provided in the first main conductor layer of the dielectric waveguide line, the high-frequency signal is fed to an antenna device disposed above the conductor non-formed portion, through the conductor non-formed portion; and a grounding conductor for electrically connecting the first and second main conductor layers constituting H surfaces is disposed in a position which is perpendicular to a signal transmission direction and at a distance substantially not more than ½ a distance between the side surfaces constituting E surfaces of the dielectric waveguide line from the side surfaces, within a distance substantially the same as a wavelength of the high-frequency signal from the conductor non-formed portion to a high-frequency signal input side or a side opposite thereto.

2. An antenna module comprising:

the antenna feeder line of claim 1; and an aperture antenna or linear antenna, disposed on the first main conductor layer of the antenna feeder line and fed with the high-frequency signal through the conductor non-formed portion.

3. An antenna feeder line comprising:

a dielectric substrate composed of a lamination of a plurality of dielectric layers;

a first main conductor layer formed on one surface of the dielectric substrate;

a second main conductor layer formed on the other surface of the dielectric substrate;

two through conductor groups in two rows formed within the dielectric substrate, each of the two through conductor groups being composed of a plurality of through conductors electrically connecting the first main conductor layer and the second main conductor layer at predetermined intervals; and sub conductor layers for electrically connecting the through conductor groups, interposed between the dielectric layers, wherein the first main conductor layer, the second main conductor layer, the two through conductor groups and the sub conductor layers form a dielectric waveguide line where a high-frequency signal is transmitted through a transmission area surrounded by the first main conductor layer, the second main conductor layer, the through conductor groups and the sub conductor layers;

a conductor non-formed portion is provided in the first main conductor layer of the dielectric waveguide line;

the high-frequency signal is fed to an antenna device disposed above the conductor non-formed portion, through the conductor non-formed portion; and a grounding conductor for electrically connecting the side surfaces constituting H surfaces is disposed in a position which is perpendicular to a signal transmission direction and at a distance substantially not more than ½ a distance between the first and second main conductor layers constituting E surfaces of the dielectric waveguide line from the first and second main conductor layers, within a distance substantially the same as a wavelength of the high-frequency signal from the conductor non-formed portion to a high-frequency signal input side or a side opposite thereto.

4. An antenna module comprising:

the antenna feeder line of claim 3; and an aperture antenna or linear antenna, disposed on the first main conductor layer of the antenna feeder line and fed with the high-frequency signal through the conductor non-formed portion.

* * * * *